US010919131B2

(12) United States Patent
Shaw

(10) Patent No.: US 10,919,131 B2
(45) Date of Patent: Feb. 16, 2021

(54) DOG BONE BUTTERFLY SLIDING TORQUE REACTOR AND A METHOD FOR OPERATING THE SAME

(71) Applicant: The Boeing Company, Chicago, IL (US)

(72) Inventor: Murphy L. Shaw, Everett, WA (US)

(73) Assignee: The Boeing Company, Chicago, IL (US)

( * ) Notice: Subject to any disclaimer, the term of this patent is extended or adjusted under 35 U.S.C. 154(b) by 315 days.

(21) Appl. No.: 16/174,537

(22) Filed: Oct. 30, 2018

(65) Prior Publication Data

US 2020/0130147 A1 Apr. 30, 2020

(51) Int. Cl.
*B25B 13/48* (2006.01)
*B25B 23/00* (2006.01)

(52) U.S. Cl.
CPC ..... *B25B 13/48* (2013.01); *B25B 23/0035* (2013.01)

(58) Field of Classification Search
CPC ..... B25B 23/0035; B25B 23/0078; B25B 23/0085; B25B 13/48; B25B 13/481
See application file for complete search history.

(56) References Cited

U.S. PATENT DOCUMENTS

| | | | | |
|---|---|---|---|---|
| 10,307,897 | B2 * | 6/2019 | Stone | B25B 23/0085 |
| 10,513,016 | B2 * | 12/2019 | Tabler | B25B 23/0078 |
| 2017/0209992 | A1 | 7/2017 | Stone et al. | |
| 2018/0250798 | A1 | 9/2018 | Tabler et al. | |

* cited by examiner

*Primary Examiner* — David B. Thomas
(74) *Attorney, Agent, or Firm* — Felix L. Fischer

(57) ABSTRACT

A torque reactor has a first body element adjustably joined to a second body element. A first key extends from the first body element to engage a first socket. A second key extends from the second body element to engage a second socket. At least one of the first key and second key is constrained to rotate over a limited rotation angle.

20 Claims, 16 Drawing Sheets

DOG BONE BUTTERFLY SLIDING TORQUE REACTOR AND A METHOD FOR OPERATING THE SAME

BACKGROUND INFORMATION

Field

Implementations shown in the disclosure relate generally to fastener installation tool systems and more particularly to implementations for a torque reactor supporting two sockets adjustably spaced on an interconnecting sliding tongue and bed with limited rotation butterfly cross shaft engagement.

Background

Torqueing of structural fasteners in aircraft structures often presents issues with respect to access to fasteners heads for reacting torque. Prior art devices for reacting torque using adjacent fastener element are available but join two sockets with a rigid interconnection. Fasteners in composite structures are typically seated and the heads sealed prior to final torqueing of nuts or collars. Often, the fastener heads are not identically aligned and engagement of a torque reactor requires rotation of one or both fastener heads to provide proper alignment with the sockets. Such adjustment may require resealing of the fastener heads.

SUMMARY

Exemplary implementations provide a torque reactor having a first body element adjustably joined to a second body element. A first key extends from the first body element to engage a first socket. A second key extends from the second body element to engage a second socket. At least one of the first key and second key is constrained to rotate over a limited rotation angle.

The exemplary implementations allow a method for reacting torque on adjacent fasteners. A first body element and a second body element are adjusted for a width of adjacent fasteners in a structure. A first socket is engaged with a first key extending from the first body element and a second socket is engaged with a second key extending from the second body element. At least one of the first key and second key is rotated within a limited rotation angle thereby aligning the first and second socket to receive heads of the adjacent fasteners.

BRIEF DESCRIPTION OF THE DRAWINGS

The features, functions, and advantages that have been discussed can be achieved independently in various implementations or may be combined in yet other implementations further details of which can be seen with reference to the following description and drawings.

DETAILED DESCRIPTION

The exemplary implementations described herein provide torque reactor which is longitudinally adjustable for various spacing of adjacent fastener heads and provides limited rotational engagement of sockets to allow orientation alignment.

Figure 1A:
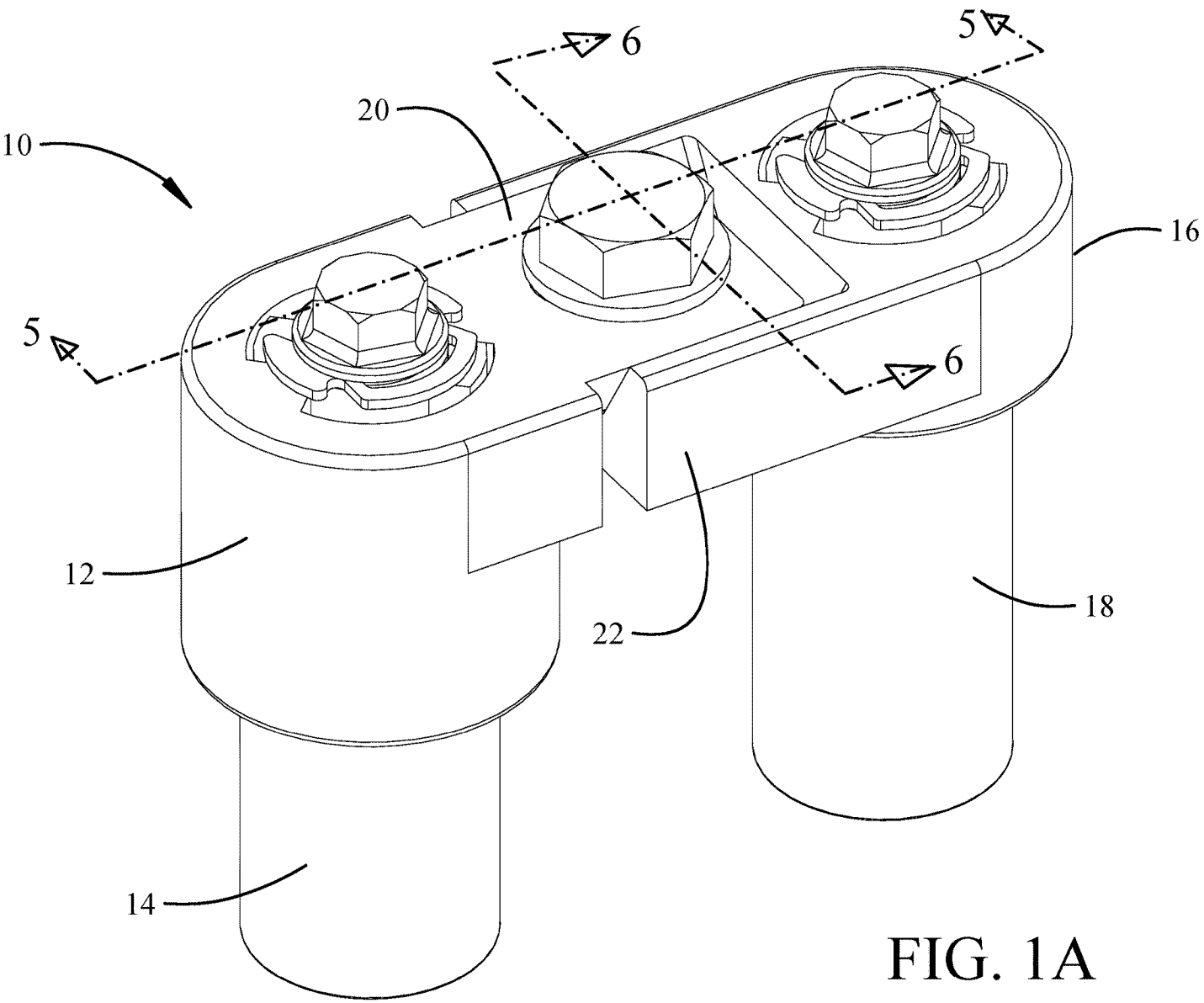
FIGS. 1A and 1B show an upper pictorial representation and a side view, respectively, of a first exemplary implementation of a torque reactor.
Figure 1B:
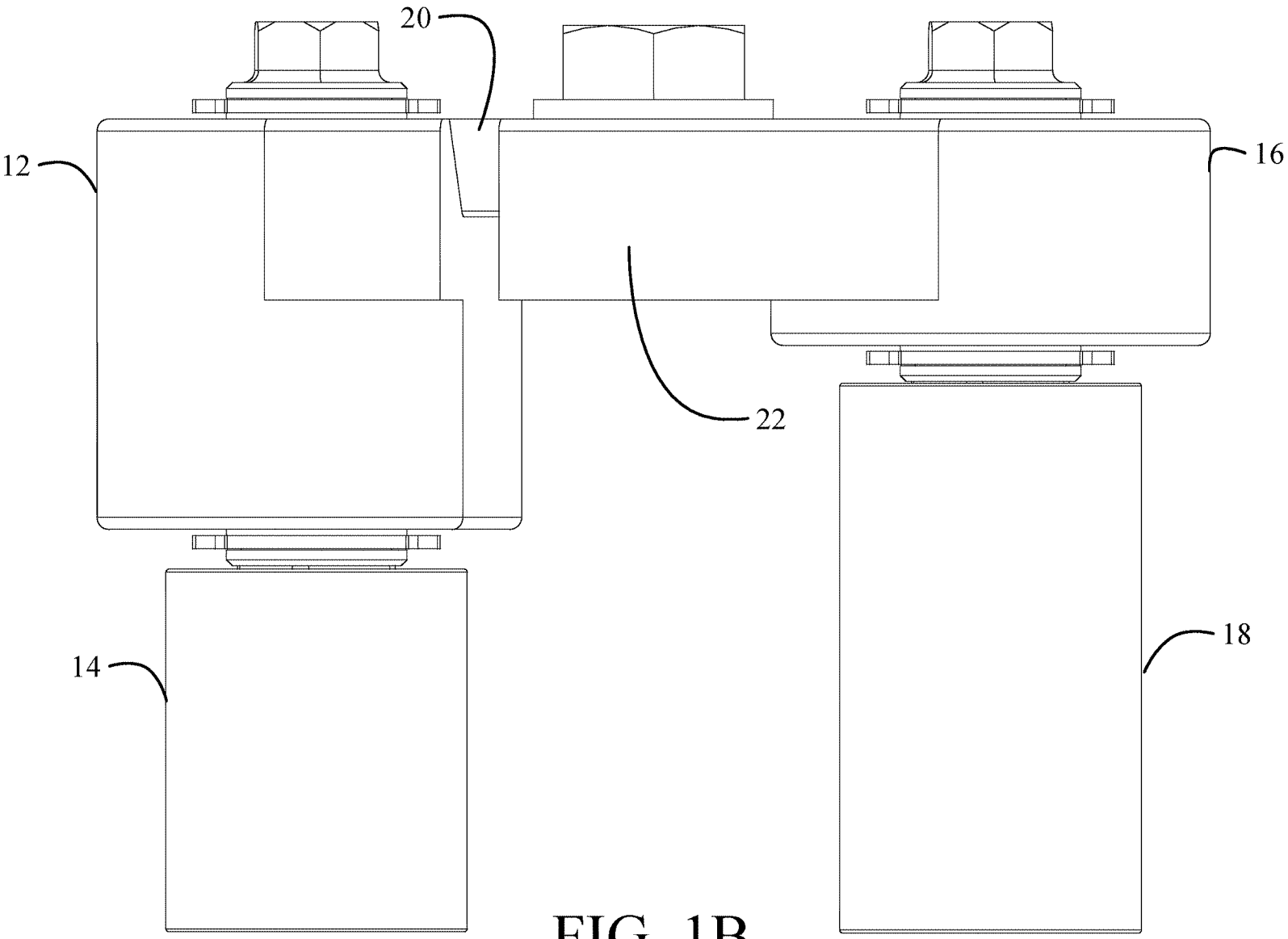
Figure 2A:
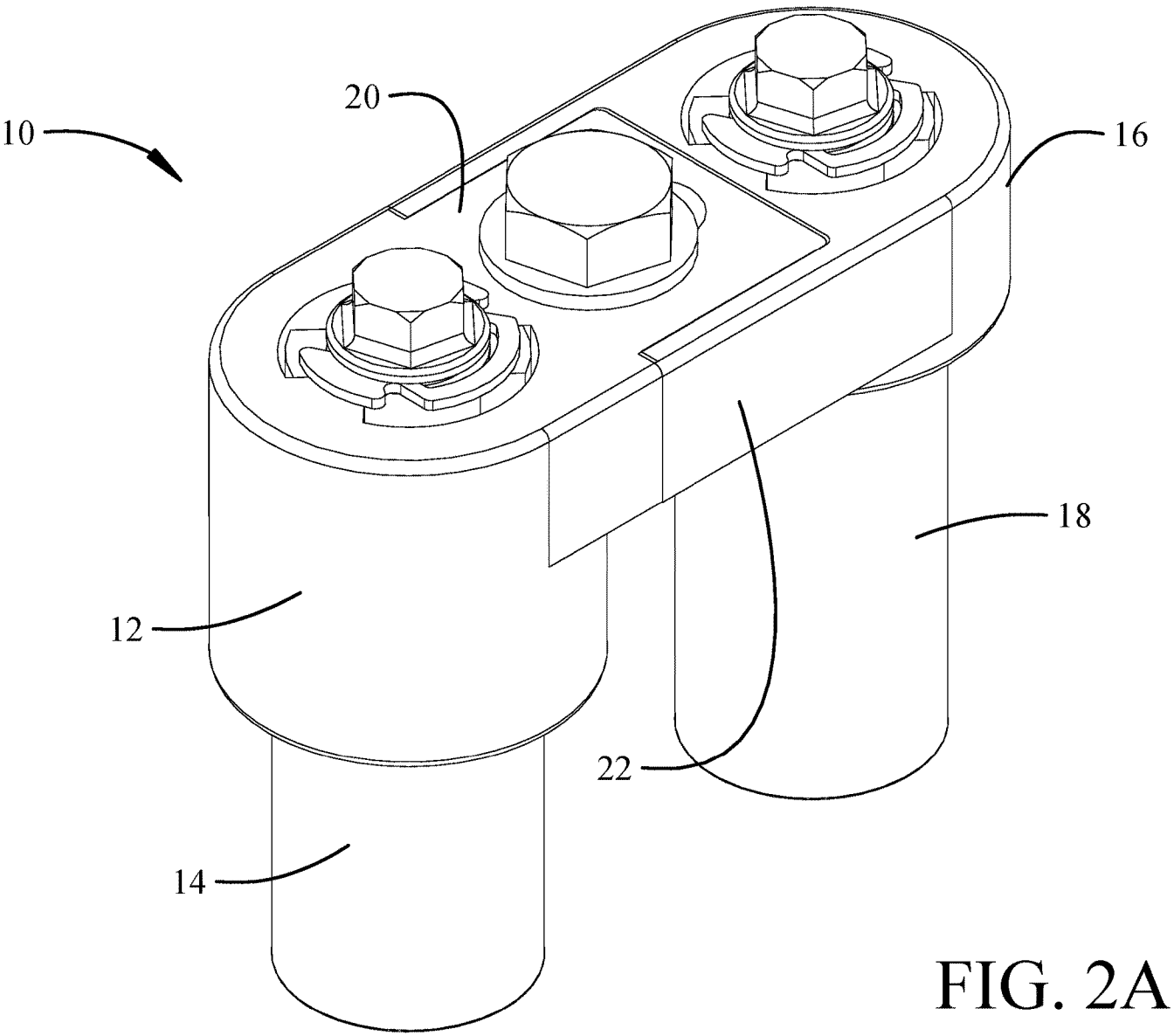
FIGS. 2A and 2B show an upper pictorial representation and a side view, respectively, of the torque reactor in a fully contracted position.
Figure 2B:
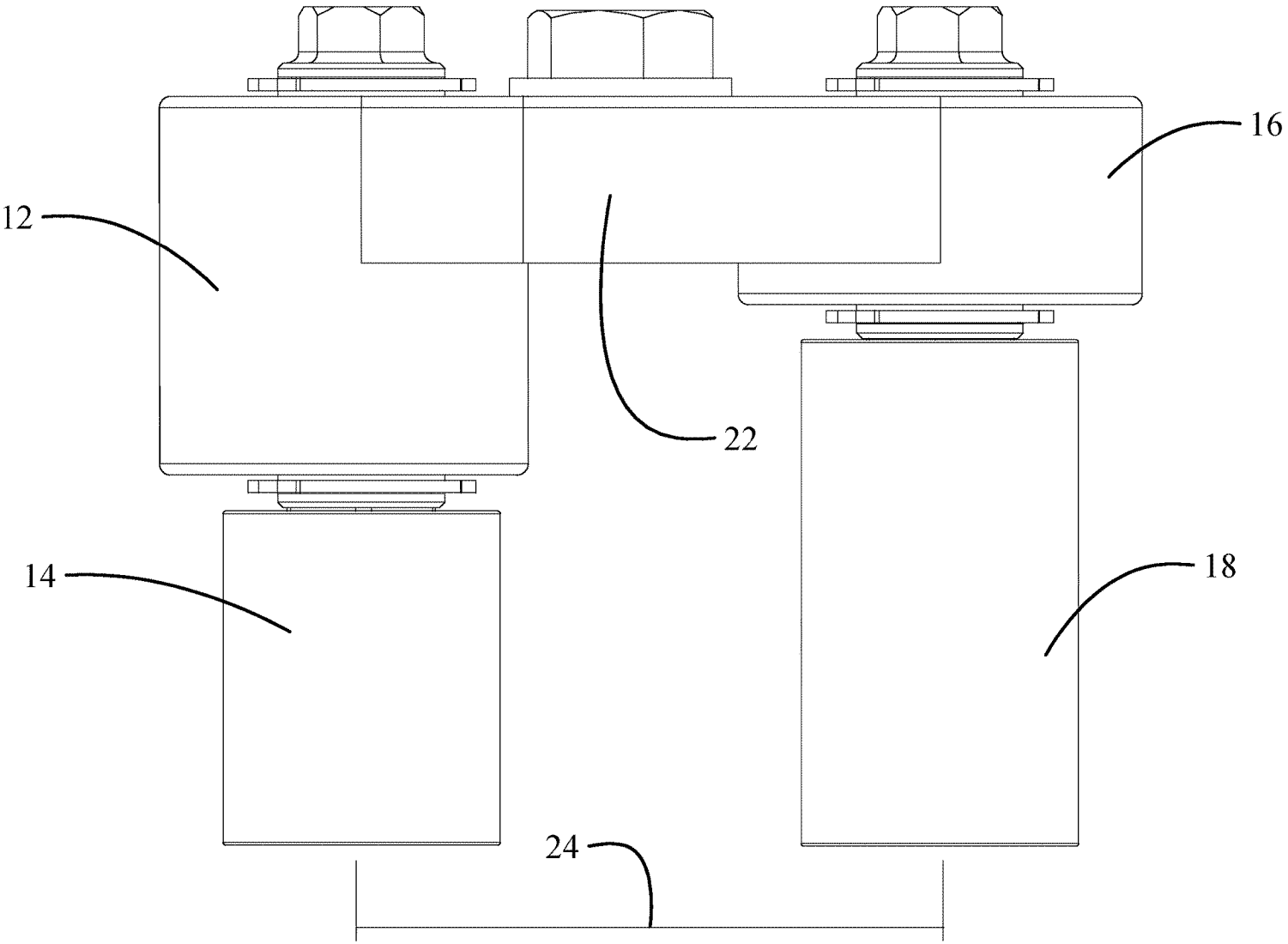
Figure 3A:
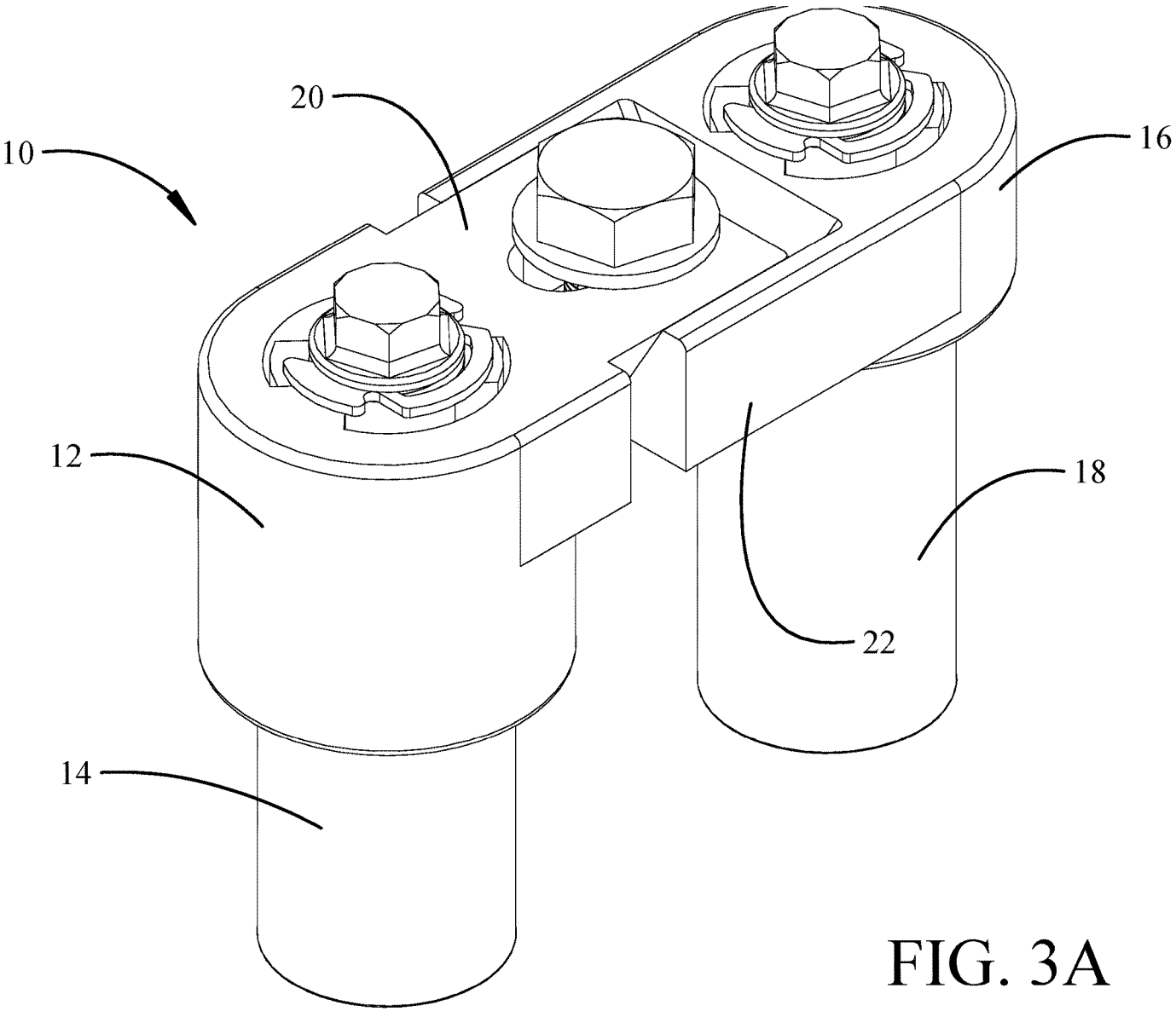
FIGS. 3A and 3B show a front upper pictorial representation and a side view, respectively, of the torque reactor in a fully expanded position.
Figure 3B:
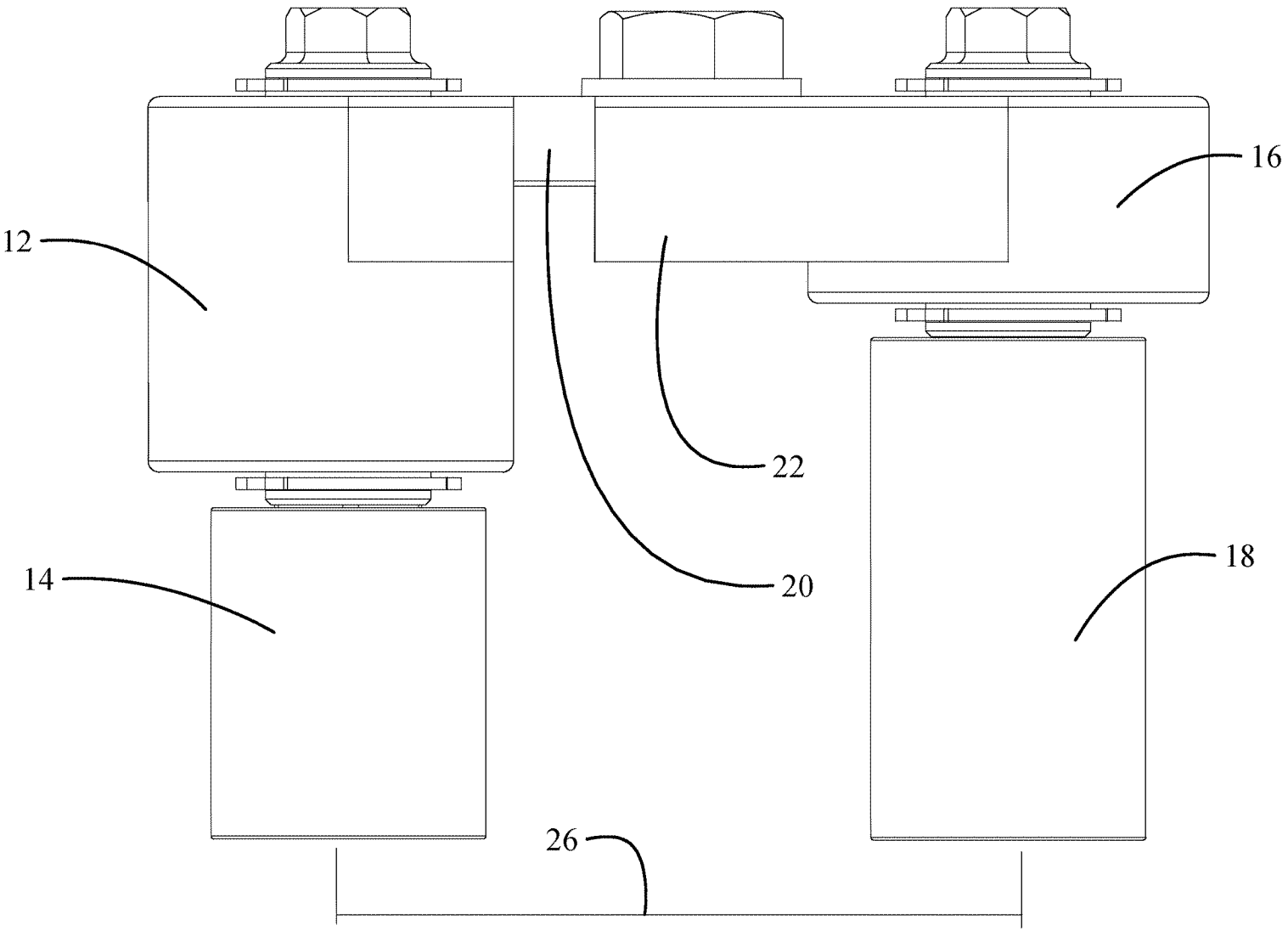

Referring to the drawings, FIGS. 1A and 1B show a torque reactor 10 having a first body element 12 configured to engage a first socket 14 and a second body element 16 configured to engage a second socket 18. A sliding tongue 20 extending from first body element 12 is adjustably received on a bed 22 extending from second body element 16 to adjustably join the body elements with longitudinal alteration of the spacing between the first socket 14 and second socket 18 to accommodate various spacing of adjacent fastener heads to be torqued. The sliding tongue 20 and bed 22 allow adjustment of the torque reactor from a fully compressed position as shown in FIGS. 2A and 2B with fastener spacing 24 to a fully expanded position as shown in FIGS. 3A and 3B with fastener spacing 26.

Figure 4A:
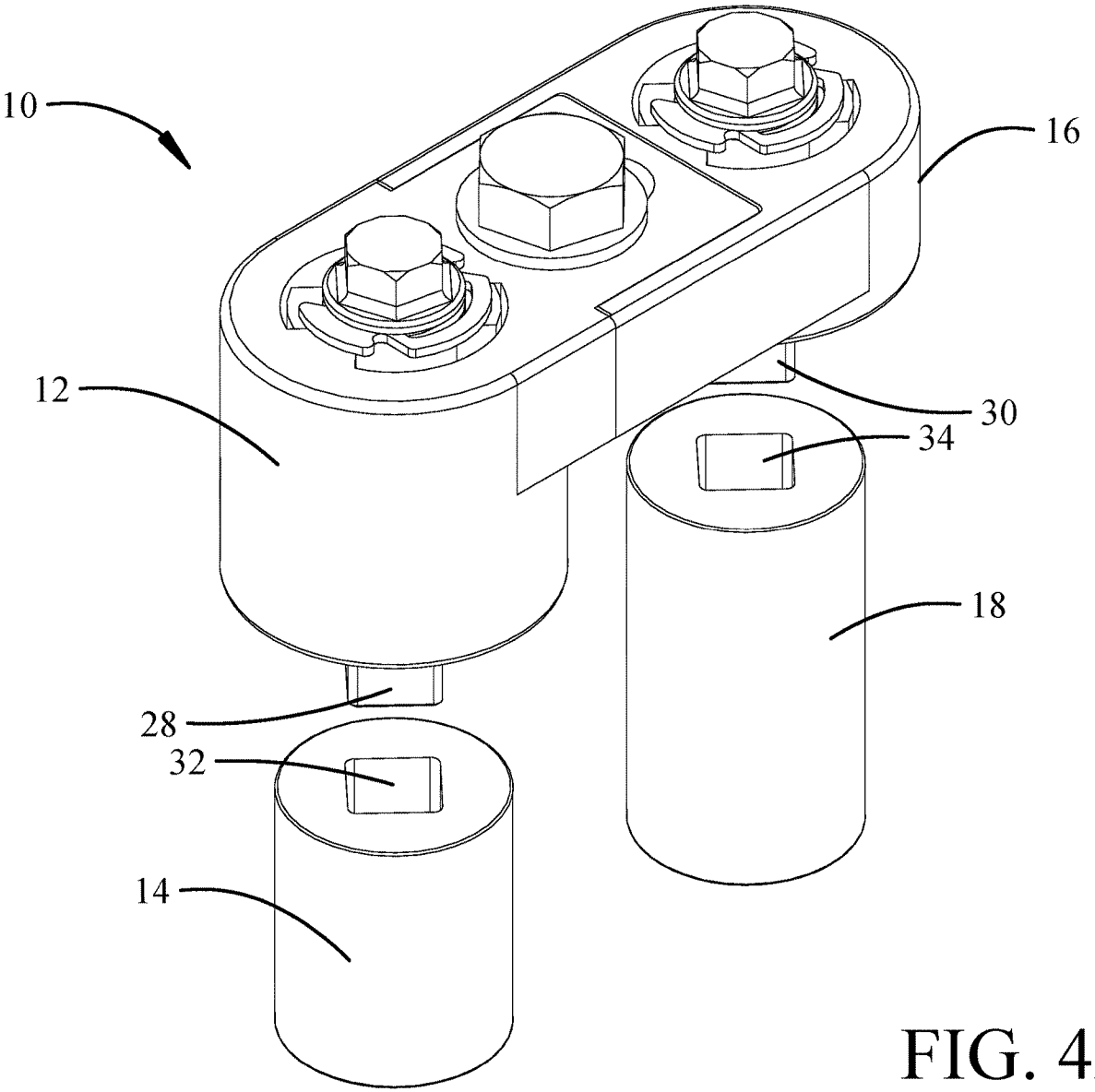
FIGS. 4A, 4B and 4C show an upper pictorial representation, a side view, and a lower pictorials representation, respectively, of the torque reactor with the sockets exploded from the body.
Figure 4B:
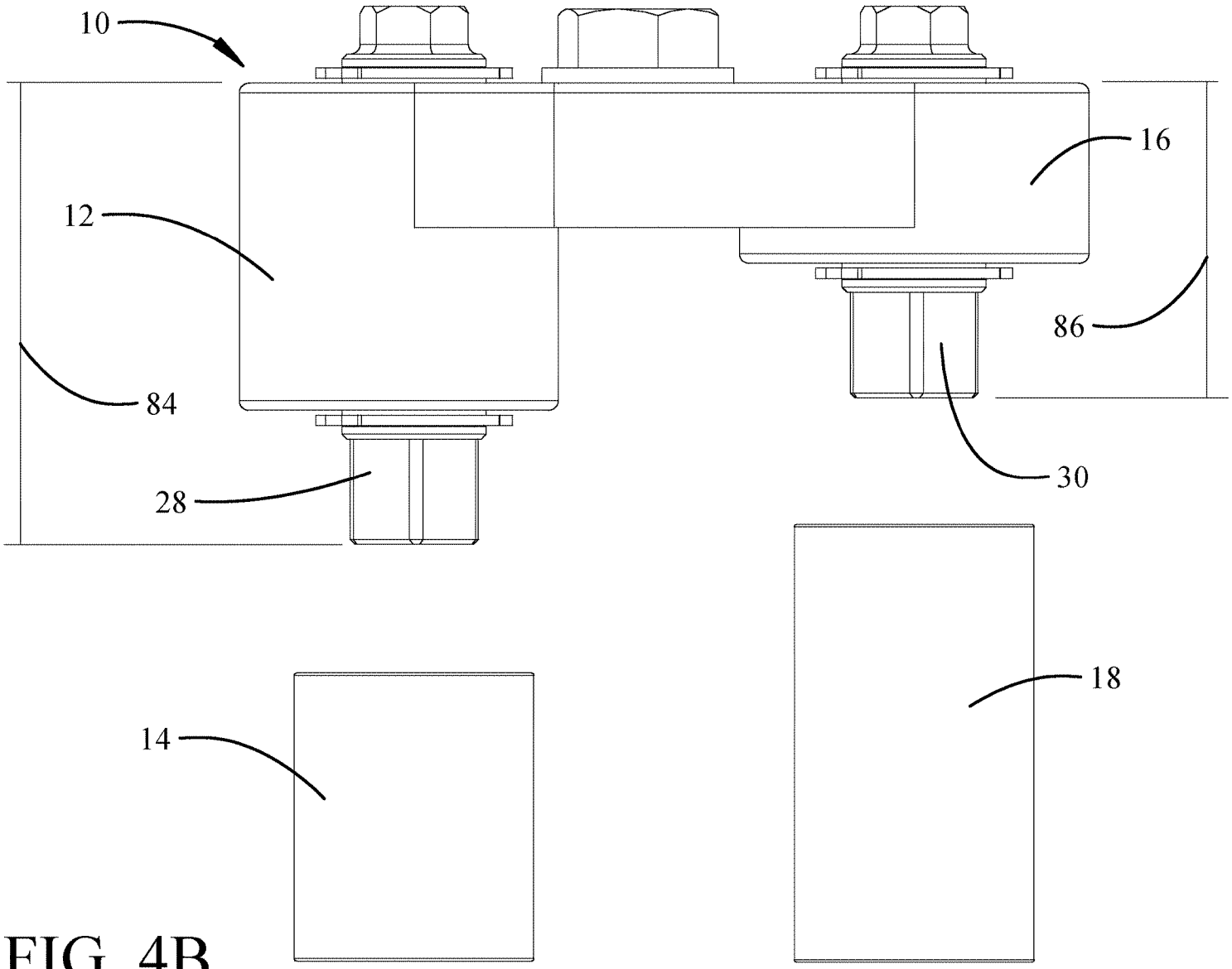
Figure 4C:
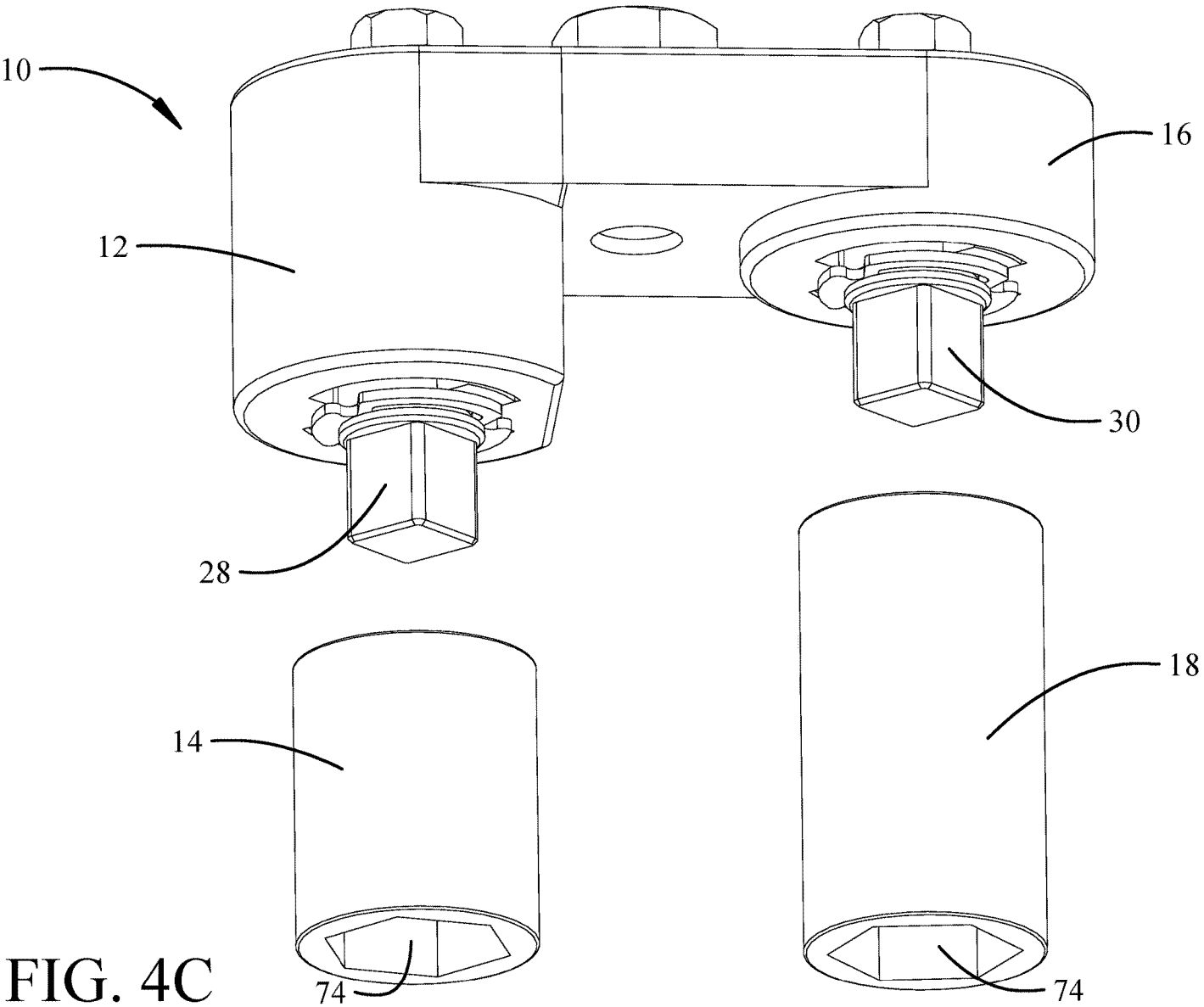
Figure 5A:
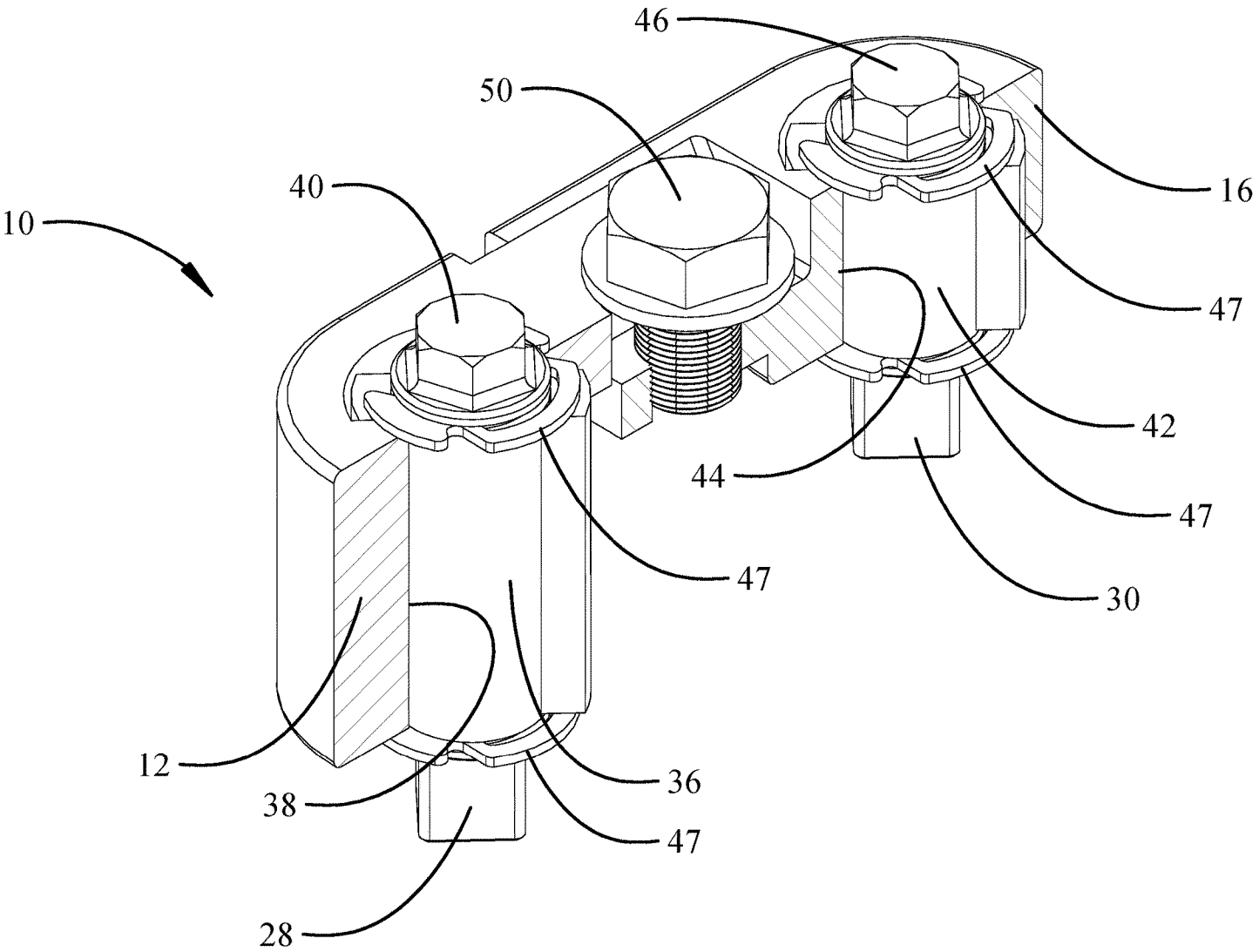
FIGS. 5A and 5B show an upper pictorial representation and a side, respectively, of the first exemplary implementation with the first and second body elements sectioned along line 5-5 of FIG. 1A.
Figure 5B:
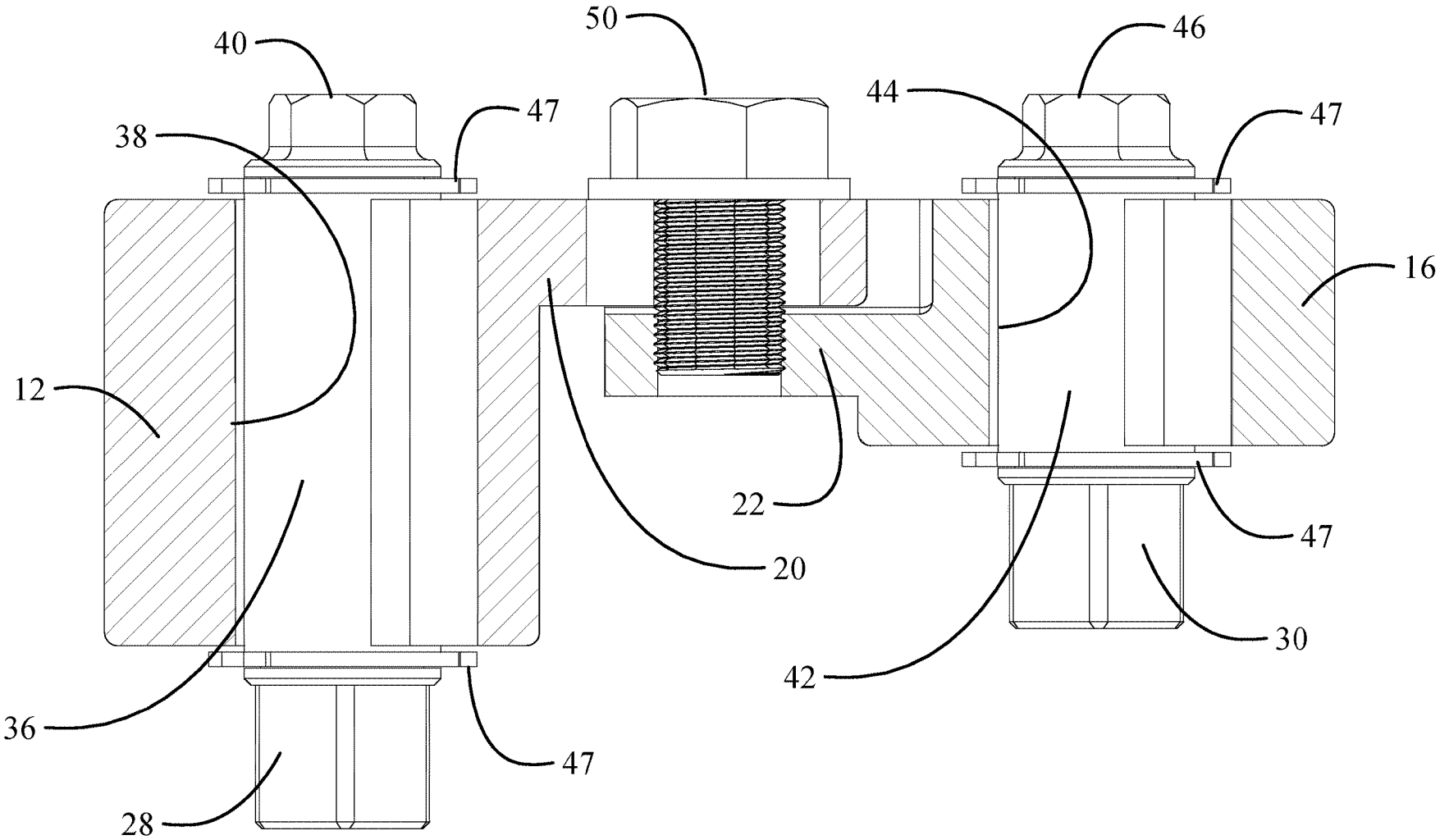

As seen in FIGS. 4A-4C, first key 28 and second key 30 extending from the first body element 12 and second body element 16, respectively, are received in first port 32 and second port 34 in first and second sockets 14 and 18 to allow sockets of varying head size and length to be employed with the torque reactor 10. As seen in FIGS. 5A and 5B, first key 28 is carried by a first shaft 36 which is rotatably received in a first bore 38 in first body element 12 and terminates in a first head 40. Second key 30 is carried by a second shaft 42 which is rotatably received in a second bore 44 in second body element 16 and terminates in second head 46. First shaft 36 and second shaft 42 are constrained in the first bore 38 and second bore 44 by spring clips 47 which engage top and bottom surfaces of the first and second body elements 12, 16.

Figure 6:
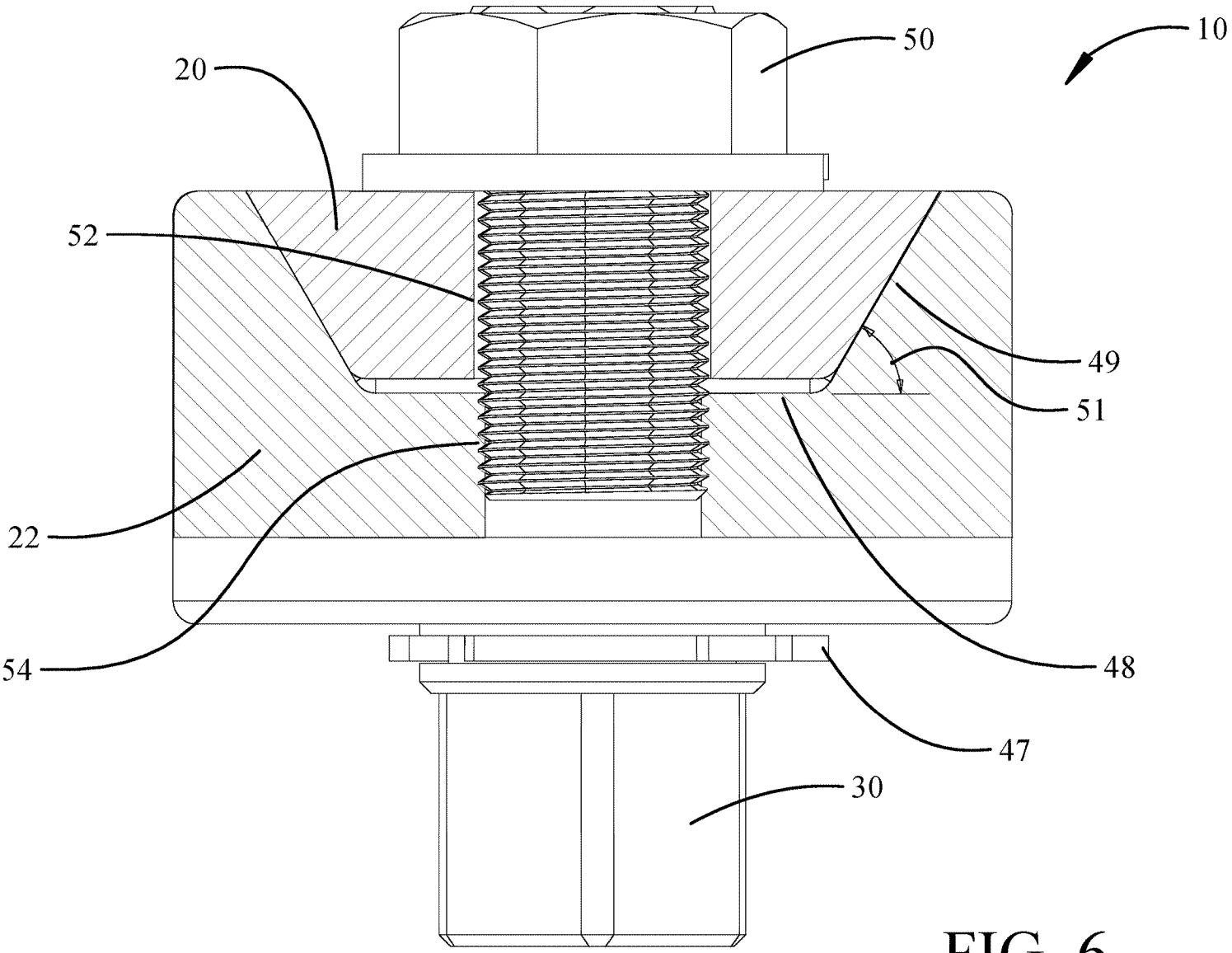
FIG. 6 shows an end section view of the torque reactor along line 6-6 of FIG. 1A.

In the exemplary implementation, sliding tongue 20 has a trapezoidal cross section received in a channel 48 in the bed 22, the channel having sides 49 with mating angles 51 to the trapezoidal cross section as seen in FIG. 6. A locking bolt 50 is received through a slot 52 (best seen in FIG. 7) and engaged in a threaded bore 54 to lock the sliding tongue 20 in position on the bed 22. The channel 48 provides constrained linear travel of the tongue 20 with respect to the bed 22 thereby assuring an aligned longitudinal adjustment of the first body element 12 and second body element 15 with the attached sockets 14, 18. However, release of the locking bolt 50 allows vertical movement of the tongue 20 from the sides 49 of the channel 48 relieving the rigid longitudinal interface between the trapezoidal cross section of the sliding tongue 20 and channel 48 thereby allowing release of any preload imposed during torqueing of the fasteners, which might create binding of the sockets on the fasteners.

Figure 7:
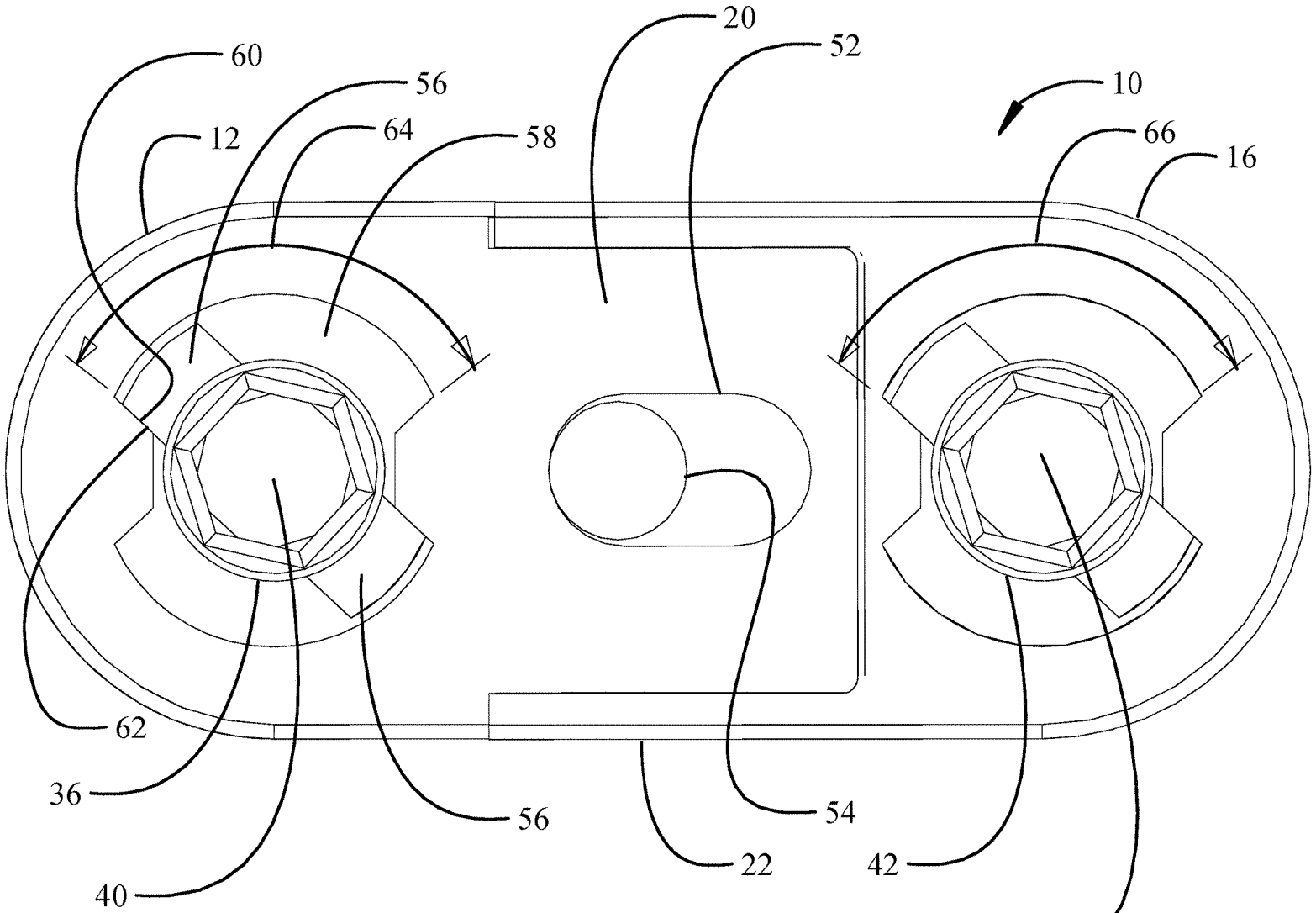
FIG. 7 is a top view of the torque reactor with the locking clips and adjustment locking bolt removed.

As also seen in FIG. 7 with the spring clips removed for clarity, at least one of the first shaft 36 and second shaft 42 have lateral extensions 56 which are received in butterfly reliefs 58 in the first bore 38 and second bore 44. Tolerances are exaggerated in the drawings for clarity of the individual elements. High speed running of the shafts within the bores 38, 44 is not present since the shafts 36, 42 and associated lateral extensions 56 are turned manually with the shaft heads 40, 46. However, close tolerance is desired to avoid axial offset between the shafts and bores which might create binding. Tolerance consistent with ANSI B 4.1 RC9 (for 1 inch shaft/extension size bore diameter 1.00+0.005-0.000; shaft and lateral extension diameter 1.00-0.007 to −0.0105, max clearance 0.0155, min clearance 0.0070) is employed in exemplary embodiments. Contact surfaces 60 on the lateral extensions 56 engage constraints 62 in the butterfly reliefs 58 allowing rotation of the first shaft 36 over a limited rotation angle 64 and rotation of the second shaft 42 over a limited rotation angle 66. For the exemplary implementation the limited rotation angles 64 and 66 are equal but may differ in alternative implementations. The allowable rotation of the first and second shafts 36 and 42 with attached first and second sockets 14 and 18 also assists in preventing binding of the sockets on the fastener heads during torqueing.

Figure 8:
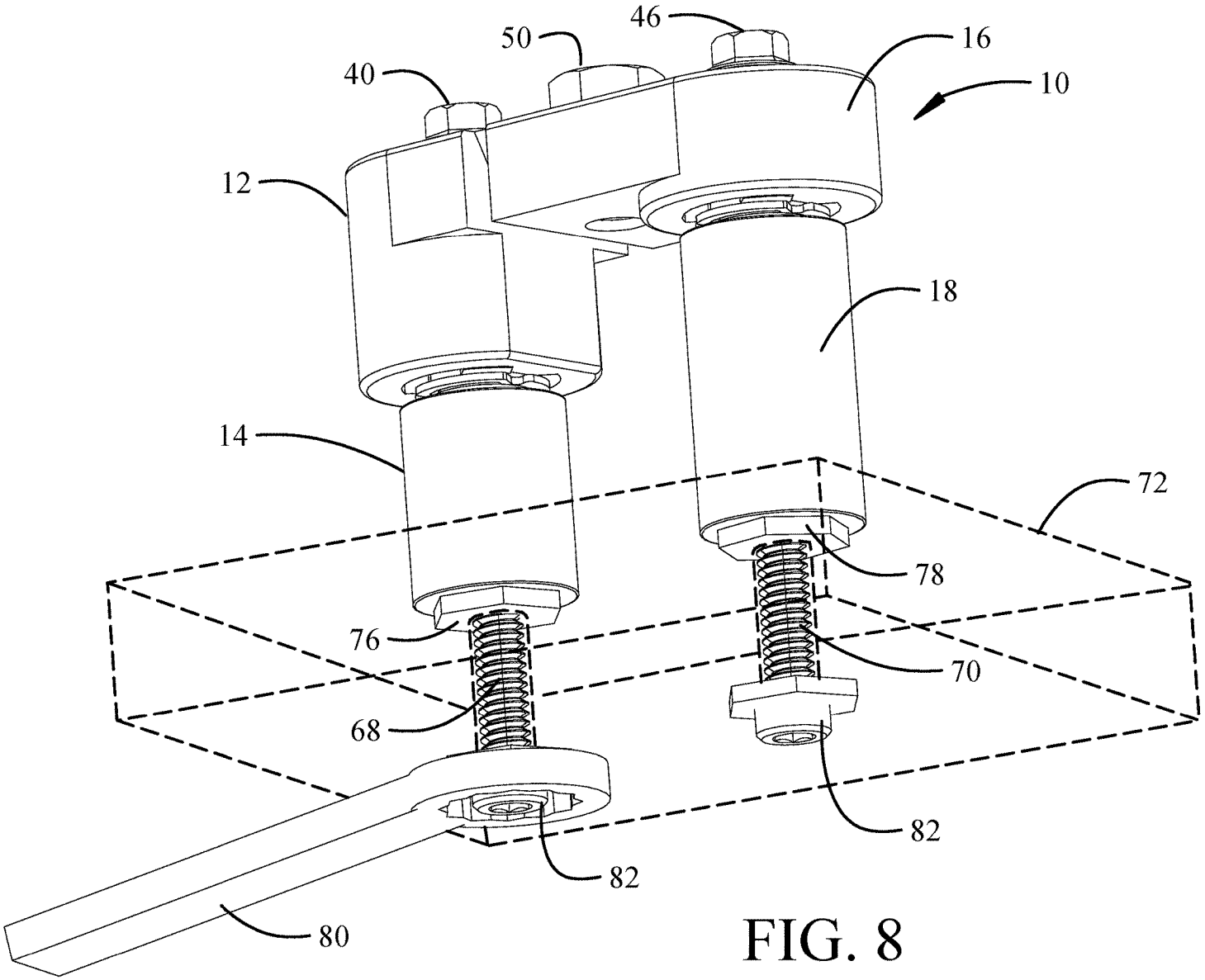
FIG. 8 is a pictorial view of the torque reactor showing attachment to adjacent fastener heads for torqueing with the engaged structure shown in phantom.

As seen in FIG. 8, the torque reactor 10 may be used to react torqueing forces for fasteners 68 and 70 present in a structure 72 (shown in phantom for clarity). First head 40 and second head 46 may be used to rotate first shaft 36 and second shaft 42, with associated first and second keys 28, 30 and attached first and second sockets 14, 18, to align socket apertures 74 in first socket 14 and second socket 18 (seen in FIG. 4C) with the flats of fastener heads 76 and 78 (shown in the drawings as hex heads) to receive the fastener heads. As previously described, rotation of the shafts and keys is limited by the contact of the lateral extensions on the constraints in the butterfly reliefs. A torqueing device (such as wrench 80 in FIG. 8 is then employed to torque the collars 82 on fasteners 68 and 70 with the torque reactor 10 providing necessary reaction force on the fastener heads.

Figure 9:
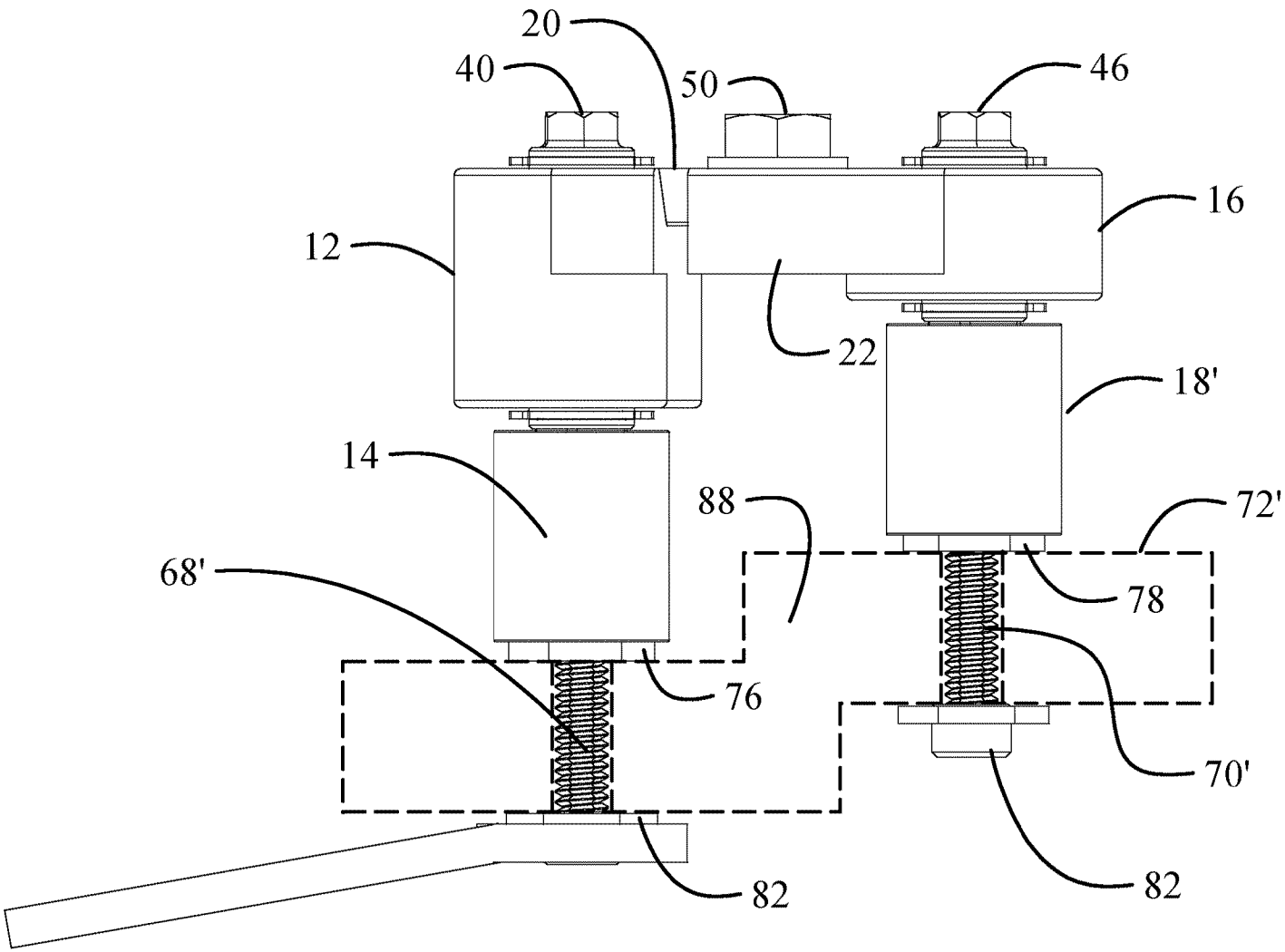
FIG. 9 is a side view of the torque reactor showing fastener step offset engagement capability; and, FIG. 10 is a flow chart showing a method for operation of a torque reactor employing the disclosed implementations.

In the exemplary implementation, the first body element 12 of torque reactor 10 and associated first shaft 36 have a first depth 84 while the second body element 16 and second shaft 42 have a second depth 86 (seen in FIG. 4B). This allows torque reactor 10 to be employed with fasteners arranged in a structure 72' having a step offset 88 whereby the first and second sockets 14 and 18' may engage the stepped fasteners 68' and 70' as shown in FIG. 9. In the exemplary embodiment, both the body element and associated shaft have a common depth. However, in alternative embodiments, only the shafts may have differing lengths to accommodate the desired difference in depth.

Figure 10:
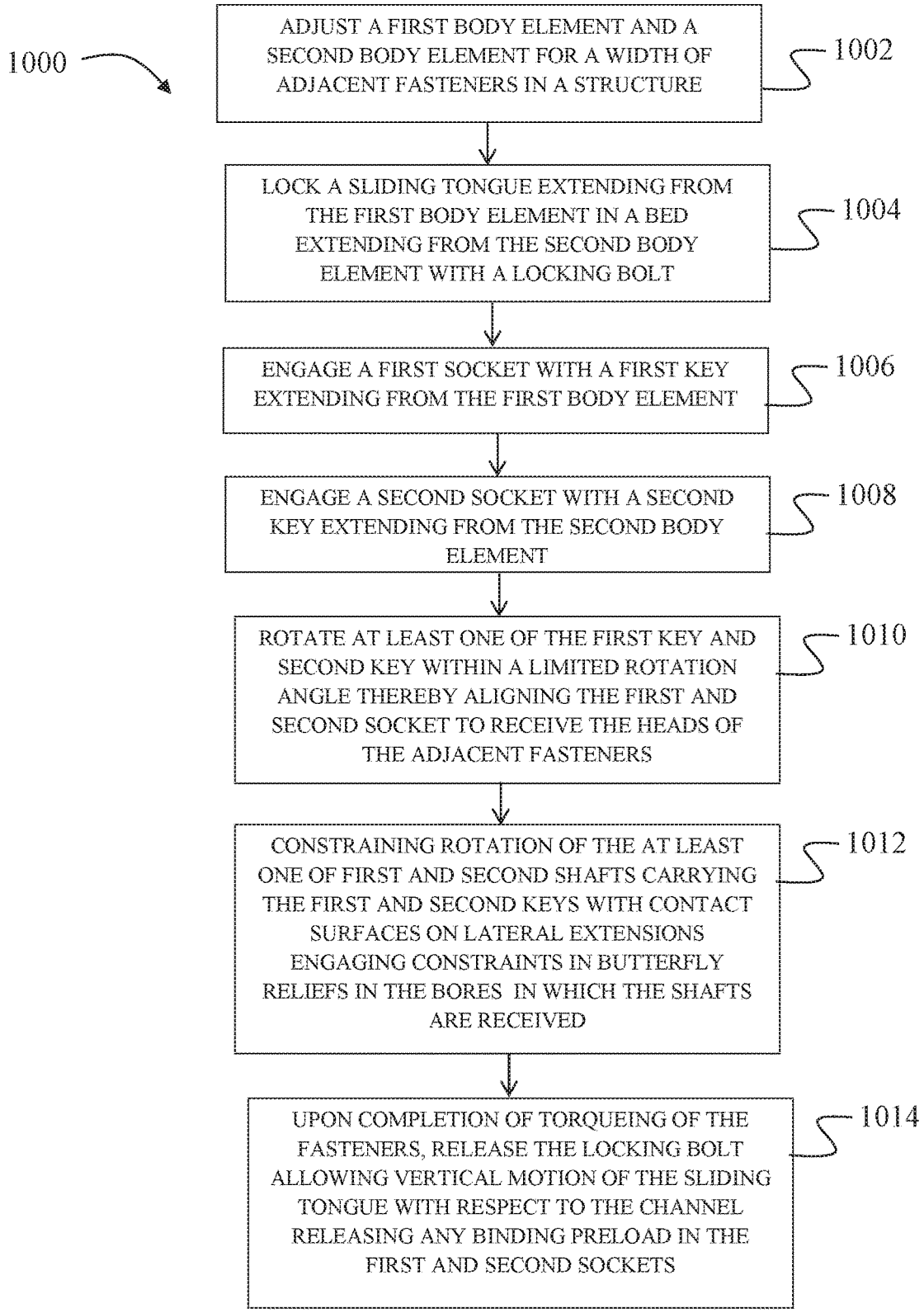

The implementations disclosed provide a method 1000 for reacting torque with paired adjacent fasteners as shown in FIG. 10. A first body element 12 and a second body element 16 are adjusted for a width of adjacent fasteners in a structure, step 1002. The adjustment is accomplished in an exemplary implementation by longitudinally adjusting a sliding tongue 20 on a bed 22 wherein the sliding tongue has a trapezoidal cross section and extends from the first body element 12 and the bed has a channel with mating angles receiving the trapezoidal cross section and extends from the second body element 16. The sliding tongue is locked to the bed with a locking bolt, step 1004. A first socket is engaged with a first key 28 extending from the first body element, step 1006 and a second socket 18 is engaged with a second key 30 extending from the second body element, step 1008. At least one of the first key 28 and second key 30 is rotated within a limited rotation angle thereby aligning the first and second socket to receive the heads of the adjacent fasteners, step 1010. The first key 28 is carried by a first shaft 36 received in a first bore 38 in first body element 12 and terminates in a first head 40 and the second key 30 is carried by a second shaft 42 received in a second bore 44 in second body element 16 and terminating in second head 46. The step of rotating at least one of the first key and second key is accomplished by rotating the first head or second head. For the exemplary implementation, at least one of the first shaft and second shaft has lateral extensions 56 received in butterfly reliefs 58 in the associated first or second bore 38, 44. Rotating at least one of the first key 28 and second key 30 within a limited rotation angle is accomplished by constraining rotation of the at least one of the first and second shafts with contact surfaces 60 on the lateral extensions 56 engaging constraints 62 in the butterfly reliefs 58, step 1012. Upon completion of torqueing of the fasteners, the locking bolt is released allowing vertical motion of the sliding tongue with respect to the channel releasing any binding preload in the first and second sockets, step 1014.

Having now described various implementations in detail as required by the patent statutes, those skilled in the art will recognize modifications and substitutions to the specific implementations disclosed herein. Such modifications are within the scope and intent of the present invention as defined in the following claims.

What is claimed is:

1. A torque reactor comprising:

a first body element adjustably joined to a second body element;

a first key extending from the first body element and configured to engage a first socket;

a second key extending from the second body element and configured to engage a second socket;

wherein at least one of the first key and second key is constrained to rotate over a limited rotation angle.

2. The torque reactor as defined in claim 1 further comprising:

a first shaft received in a first bore in first body element, the first shaft carrying the first key and terminating in a first head;

a second shaft received in a second bore in second body element, the second shaft carrying the second key and terminating in second head, at least one of said first shaft and second shaft constrained to rotate over the limited rotation angle.

3. The torque reactor as defined in claim 2 wherein the at least one of said first shaft and second shaft has lateral extensions received in butterfly reliefs in the associated first or second bore and wherein contact surfaces on the lateral extensions engage constraints in the butterfly reliefs constraining rotation of the at least one of said first and second shafts to the limited rotation angle.

4. The torque reactor as defined in claim 2 wherein the first body element and associated first shaft have a first depth while the second body element and second shaft have a second depth whereby fasteners arranged in a structure having a step offset are engaged by the first and second sockets.

5. The torque reactor as defined in claim 1 further comprising:

a sliding tongue extending from first body element adjustably received on a bed extending from second body element joining the first and second body elements whereby spacing between the first socket and second socket is longitudinally adjustable to accommodate various spacing of adjacent fastener heads to be torqued, the sliding tongue and bed adapted to allow adjustment from a fully compressed position to a fully expanded position.

6. The torque reactor as defined in claim 5 wherein the sliding tongue has a trapezoidal cross section received in a channel in the bed, said channel having sides with mating angles for the trapezoidal cross section.

7. The torque reactor as defined in claim 6 further comprising a locking bolt received through a slot in the sliding tongue into a threaded bore in the bed whereby loosening the locking bolt allows adjustment to any position in a range from the fully compressed position to the fully expanded position.

8. The torque reactor as defined in claim 7 wherein releasing the locking bolt from threaded bore in the bed releases the trapezoidal cross section for vertical movement from the channel to release any binding preload in the first and second sockets.

9. A torque reactor comprising:

a first body element and a second body element;

a first key extending from the first body element and configure to engage a first socket;

a second key extending from the second body element and configured to engage a second socket;

a sliding tongue extending from first body element adjustably received on a bed extending from second body element joining the first and second body elements whereby spacing between the first socket and second socket is longitudinally adjustable to accommodate various spacing of adjacent fastener heads to be torqued, the sliding tongue and bed adapted to allow adjustment from a fully compressed position to a fully expanded position;

wherein the first body element has a first depth while the second body element has a second depth whereby fasteners arranged in a structure having a step offset are engaged by the first and second sockets.

10. The torque reactor as defined in claim 9 wherein at least one of the first key and second key is constrained to rotate over a limited rotation angle.

11. The torque reactor as defined in claim 10 further comprising:

a first shaft received in a first bore in first body element, the first shaft carrying the first key and terminating in a first head;

a second shaft received in a second bore in second body element, the second shaft carrying the second key and terminating in second head, at least one of said first shaft and second shaft constrained to rotate over the limited rotation angle.

12. The torque reactor as defined in claim 11 wherein the at least one of said first shaft and second shaft has lateral extensions received in butterfly reliefs in the associated first or second bore and wherein contact surfaces on the lateral extensions engage constraints in the butterfly reliefs constraining rotation of the at least one of said first and second shafts to the limited rotation angle.

13. The torque reactor as defined in claim 9 wherein the sliding tongue has a trapezoidal cross section received in a channel in the bed, said channel having sides with mating angles for the trapezoidal cross section.

14. The torque reactor as defined in claim 13 further comprising a locking bolt received through a slot in the sliding tongue into a threaded bore in the bed whereby loosening the locking bolt allows adjustment to any position in a range from the fully compressed position to the fully expanded position.

15. The torque reactor as defined in claim 14 wherein releasing the locking bolt from threaded bore in the bed releases the trapezoidal cross section for vertical movement from the channel to release any binding preload in the first and second sockets.

16. A method for reacting torque on adjacent fasteners, said method comprising:

adjusting a first body element and a second body element for a width of adjacent fasteners in a structure;

engaging a first socket with a first key extending from the first body element;

engaging a second socket with a second key extending from the second body element and;

rotating at least one of the first key and second key within a limited rotation angle thereby aligning the first and second socket to receive heads of the adjacent fasteners.

17. The method as defined in claim 16 wherein the first key is carried by a first shaft received in a first bore in first body element, said first shaft terminating in a first head and the second key is carried by a second shaft received in a second bore in second body element, the second shaft terminating in second head, wherein the step of rotating at least one of the first key and second key comprises rotating the first head or second head.

18. The method as defined in claim 17 wherein at least one of said first shaft and second shaft has lateral extensions received in butterfly reliefs in the associated first or second bore and wherein rotating at least one of the first key and second key within a limited rotation angle comprises constraining rotation of the at least one of said first and second shafts to the limited rotation angle with contact surfaces on the lateral extensions engaging constraints in the butterfly reliefs.

19. The method as defined in claim 16 wherein the step of adjusting a first body element and a second body element comprises longitudinally adjusting a sliding tongue having a trapezoidal cross section and extending from the first body element and received on a bed having a channel with mating angles receiving the trapezoidal cross section and extending from second body element and securing the sliding tongue to the bed with a locking bolt.

20. The method as defined in claim 19 further comprising releasing the locking bolt allowing vertical motion of the sliding tongue with respect to the channel releasing any binding preload in the first and second sockets.

* * * * *